US008142575B2

(12) United States Patent
Oki et al.

(10) Patent No.: US 8,142,575 B2
(45) Date of Patent: Mar. 27, 2012

(54) HIGH STRENGTH ALUMINUM ALLOY FIN MATERIAL FOR HEAT EXCHANGER AND METHOD FOR PRODUCTION THEREOF

(75) Inventors: Yoshito Oki, Shizuoka (JP); Hideki Suzuki, Shizuoka (JP); Haruo Sugiyama, Shizuoka (JP); Toshiya Anami, Shizuoka (JP); Tomohiro Sasaki, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 670 days.

(21) Appl. No.: 10/587,568

(22) PCT Filed: Jan. 28, 2005

(86) PCT No.: PCT/JP2005/001195

§ 371 (c)(1),
(2), (4) Date: Jan. 10, 2007

(87) PCT Pub. No.: WO2005/075691

PCT Pub. Date: Aug. 18, 2005

(65) Prior Publication Data

US 2007/0113936 A1 May 24, 2007

(30) Foreign Application Priority Data

Feb. 3, 2004 (JP) ..... 2004-026749

(51) Int. Cl.
*C22C 21/00* (2006.01)

(52) U.S. Cl. ..... 148/437; 148/549; 148/552; 148/696; 420/528; 420/540; 420/548; 420/550

(58) Field of Classification Search ..... 148/437, 148/549–552, 696; 420/528, 540, 548, 550
See application file for complete search history.

(56) References Cited

U.S. PATENT DOCUMENTS

| | | | | |
|---|---|---|---|---|
| 3,490,955 | A * | 1/1970 | Joseph et al. | 148/502 |
| 5,725,695 | A | 3/1998 | Ward et al. | |
| 5,833,775 | A | 11/1998 | Newton et al. | |
| 5,976,279 | A | 11/1999 | Selepack et al. | |

FOREIGN PATENT DOCUMENTS

| | | |
|---|---|---|
| JP | 1 247542 | 10/1989 |
| JP | 2-51210 | 2/1990 |
| JP | 7-150281 | 6/1995 |
| JP | 7-155935 | 6/1995 |
| JP | 2002 161323 | 6/2002 |
| JP | 2004-176091 | 6/2004 |
| JP | 2005-60790 | 3/2005 |

OTHER PUBLICATIONS

Lyle et al. "Aluminum Alloys." Ullmann's Encyclopedia of Industrial Chemistry. Jun. 15, 2000.*
Sanders. "Aluminum and Aluminum Alloys." Kirk-Othmer Encyclopedia of Chemical Technology. pp. 279-343. Nov. 15, 2002.*
Notice of Rejection issued Sep. 8, 2009, in JP 2004-26749 (English translation).
Canadian Office Action issued Aug. 15, 2011, in Patent Application No. 2,553,910.

* cited by examiner

*Primary Examiner* — Stanley Silverman
*Assistant Examiner* — Brian Walck
(74) *Attorney, Agent, or Firm* — Oblon, Spivak, McClelland, Maier & Neustadt, L.L.P.

(57) ABSTRACT

[PROBLEMS] To provide an aluminum alloy fin material for a heat exchanger, which has high strength and high heat conductivity after brazing, and is excellent in the resistance to sagging, erosion and self-corrosion and the in the sacrificial anode effect.
[MEANS FOR SOLVING PROBLEMS] A method for producing an aluminum alloy fin material for a heat exchanger which comprises providing a molten aluminum alloy having a chemical composition, in wt %, that Si: 0.5 to 1.5%, Fe: 0.15 to 1.00%, Mn: 0.8 to 3.0%, Zn: 0.5 to 2.5%, with the proviso that the content of Mg as an impurity is limited to 0.05 wt % or less, and the balance: Al and inevitable impurities, casting the molten alloy continuously into a thin slab having a thickness of 5 to 10 mm by the use of a twin belt casting machine, winding up the slab into a roll, cold-rolling the slab into a sheet having a thickness of 0.05 to 2.0 mm, subjecting the sheet to an inter annealing at 350 to 500° C., and cold-rolling the annealed sheet with a cold reduction rate of 10 to 96%, to prepare a sheet having a final thickness of 40 to 200 μm, and optionally subjecting the final sheet to a final annealing (a softening process) at a holding temperature of 300 to 400° C.

27 Claims, No Drawings

HIGH STRENGTH ALUMINUM ALLOY FIN MATERIAL FOR HEAT EXCHANGER AND METHOD FOR PRODUCTION THEREOF

CROSS REFERENCE TO RELATED APPLICATION

This application is a 371 of PCT/JP05/001195, filed on Jan. 28, 2005, and claims priority to Japanese Patent Application No. 2004-026749, filed on Feb. 3, 2004.

TECHNICAL FIELD

The present invention relates to an aluminum alloy fin material for heat exchangers that is highly suited to brazing and a method for production thereof, and specifically to an aluminum alloy fin material used in heat exchangers such as radiators, automobile heaters and automobile air conditioners and a method for production thereof in which fins are brazed to the component materials of a working fluid conduit, the aluminum alloy fin material for heat exchangers being such that the strength prior to brazing is suitable for easily forming the fins, in other words, the strength prior to brazing is not so strong as to make fin formation easy, while the strength after brazing is high, and excelling in thermal conductivity, erosion resistance, sag resistance, sacrificial anode effect and self-corrosion resistance.

BACKGROUND ART

The heat exchangers of radiators, air conditioners, intercoolers and oil coolers in automobiles are assembled by brazing together working fluid conduit component materials consisting of Al—Cu alloys, Al—Mn alloys, Al—Mn—Cu alloys and the like with fins consisting of Al—Mn alloys and the like. The fin materials need to have a sacrificial anode effect in order to protect against corrosion of the working fluid conduit component materials, and must have sag resistance and erosion resistance to prevent deformation or permeation of braze due to the high temperatures attained during brazing.

The reason that Al—Mn aluminum alloys such as JIS 3003 and JIS 3203 are used as fin materials is that Mn functions effectively to prevent deformation and corrosion during brazing. In order to provide an Al—Mn alloy fin material with a sacrificial anode effect, there is a method of adding Zn, Sn or In to the alloy to make it electrochemically anodic (Patent Document 1 (Japanese Patent Application, First Publication No. S62-120455)), and in order to further raise the high-temperature sag resistance, there is a method of adding Cr, Ti or Zr in the Al—Mn alloy (Patent Document 2 (Japanese Patent Application, First Publication No. S50-118919)).

On the other hand, in recent years, there has been an increased demand for lightening and cost reduction of heat exchangers, and it is becoming necessary to make the heat exchanger component materials such as working fluid conduit component materials and fin materials even thinner. However, making the fins thinner reduces the thermal conductivity due to small cross section and thus decreases the heat exchange efficiency, and can cause problems in terms of strength and durability of the heat exchangers when actually subjected to use, so that better thermal conductivity, strength after brazing, sag resistance, erosion resistance and self-corrosion resistance are desired.

With conventional Al—Mn alloys, the Mn forms a solid solution due to the application of heat during brazing, thus reducing thermal conductivity. As a fin material capable of overcoming this difficulty, an aluminum alloy with the Mn content restricted to 0.8 wt % or less and containing 0.02-0.2 wt % of Zr and 0.1-0.8 wt % of Si has been proposed (Patent Document 3 (Japanese Patent Publication, Second Publication No. S63-23260)). While this alloy has improved thermal conductivity, it has the drawback of containing little Mn, so that the strength after brazing is insufficient, and it is susceptible to fin damage and deformation during use as a heat exchanger, and the electrical potential is not anodic enough so that the sacrificial anode effect is small.

On the other hand, by increasing the cooling speed when casting a slab by pouring an aluminum alloy melt, the size of intermetallic compounds crystallizing in the slab stage can be made small with a maximum value of 5 μm or less even if the Si and Mn content is made 0.05-1.5 mass %, and a process of rolling from such a slab has been proposed to improve the fatigue properties of the fin material (Patent Document 4 (Japanese Patent Application, First Publication No. 2001-226730)). However, the purpose of this invention is to improve the fatigue lifetime, and while there is a description to the effect that the cast slab can be made thinner as means for increasing the cooling speed when casting the slab, there is no specific disclosure such as of continuous casting of thin slabs by twin belt casting machines under actual operation.

Patent Document 1: Japanese Patent Application, First Publication No. S62-120455

Patent Document 2: Japanese Patent Application, First Publication No. S50-118919

Patent Document 3: Japanese Patent Publication, Second Publication No. S63-23260

Patent Document 4: Japanese Patent Application, First Publication No. 2001-226730

DISCLOSURE OF THE INVENTION

Problems to be Solved by the Invention

The purpose of the present invention is to offer an aluminum alloy fin material for heat exchangers whose strength prior to brazing is suitable for easily forming the fins, while having a high strength after brazing, and excelling in sag resistance, erosion resistance, self-corrosion resistance and sacrificial anode effect, and a method of production thereof.

Means for Solving the Problems

In order to achieve the above purpose, a method of producing a aluminum alloy fin material for heat exchangers according to the present invention is characterized by pouring a melt comprising 0.8-1.4 wt % of Si, 0.15-0.7 wt % of Fe, 1.5-3.0 wt % of Mn and 0.5-2.5 wt % of Zn, further having Mg as an impurity limited to 0.05 wt % or less and pouring a melt the remainder consisting of the inevitable impurities and Al; continuously casting thin slabs that are 5-10 mm thick by means of a twin belt casting machine and winding them into rolls; cold rolling to a sheet thickness of 0.05-2.0 mm; performing an inter anneal at a temperature of 350-500° C.; cold rolling at a cold reduction rate of 10-96% to a final sheet thickness of 40-200 μm; then performing a final anneal (softening process) at a temperature of 300-400° C. according to need. The present invention includes the five embodiments described below. The thin slabs that are continuously cast are cold rolled after first winding them onto rolls.

A first embodiment of the present invention is a high-strength aluminum alloy fin material for heat exchangers having high strength and excelling in thermal conductivity, erosion resistance, sag resistance, sacrificial anode effect and self-corrosion resistance, characterized by comprising 0.8-1.4 wt % of Si, 0.15-0.7 wt % of Fe, 1.5-3.0 wt % of Mn and 0.5-2.5 wt % of Zn, further having Mg as an impurity limited to 0.05 wt % or less and the remainder consisting of the inevitable impurities and Al; and having a tensile strength before brazing of 240 MPa or less; and a tensile strength after brazing of 150 MPa or more.

A second embodiment of the present invention is a high-strength aluminum alloy fin material for heat exchangers having high strength and excelling in thermal conductivity, erosion resistance, sag resistance, sacrificial anode effect and self-corrosion resistance, characterized by comprising 0.8-1.4 wt % of Si, 0.15-0.7 wt % of Fe, 1.5-3.0 wt % of Mn and 0.5-2.5 wt % of Zn, further having Mg as an impurity limited to 0.05 wt % or less and the remainder consisting of the inevitable impurities and Al; and having a tensile strength before brazing of 240 MPa or less; a tensile strength after brazing of 150 MPa or more; and a recrystallized grain size after brazing of 500 μm or more.

A third embodiment of the present invention is a method of producing a high-strength aluminum alloy fin material for heat exchangers having a tensile strength before brazing of 240 MPa or less and a tensile strength after brazing of 150 MPa or more, characterized by pouring a melt comprising 0.8-1.4 wt % of Si, 0.15-0.7 wt % of Fe, 1.5-3.0 wt % of Mn and 0.5-2.5 wt % of Zn, further having Mg as an impurity limited to 0.05 wt % or less and the remainder consisting of the inevitable impurities and Al; continuously casting thin slabs that are 5-10 mm thick by means of a twin belt casting machine and winding them into rolls; cold rolling to a sheet thickness of 0.05-0.4 mm; performing a inter anneal at a temperature of 350-500° C.; and cold rolling at a cold reduction rate of 10-50% to a final sheet thickness of 40-200 μm.

A fourth embodiment of the present invention is a method of producing a high-strength aluminum alloy fin material for heat exchangers having a tensile strength before brazing of 240 MPa or less and a tensile strength after brazing of 150 MPa or more, characterized by pouring a melt comprising 0.8-1.4 wt % of Si, 0.15-0.7 wt % of Fe, 1.5-3.0 wt % of Mn and 0.5-2.5 wt % of Zn, further having Mg as an impurity limited to 0.05 wt % or less and the remainder consisting of the inevitable impurities and Al; continuously casting thin slabs that are 5-10 mm thick by means of a twin belt casting machine and winding them into rolls; cold rolling to a sheet thickness of 0.08-2.0 mm; performing an inter anneal at a temperature of 350-500° C.; cold rolling at a cold reduction rate of 50-96% to a final sheet thickness of 40-200 μm; then performing a final anneal at a temperature of 300-400° C.

A fifth embodiment of the present invention is a method of producing a high-strength aluminum alloy fin material for heat exchangers having a tensile strength before brazing of 240 MPa or less and a tensile strength after brazing of 150 MPa or more, characterized by pouring a melt comprising 0.8-1.4 wt % of Si, 0.15-0.7 wt % of Fe, 1.5-3.0 wt % of Mn and 0.5-2.5 wt % of Zn, further having Mg as an impurity limited to 0.05 wt % or less and the remainder consisting of the inevitable impurities and Al; continuously casting thin slabs that are 5-10 mm thick by means of a twin belt casting machine and winding them into rolls; cold rolling to a sheet thickness of 0.08-2.0 mm; performing an interanneal at a temperature of 350-500° C. in a continuous annealing furnace with a heating rate of 100° C./min or more and a holding (retention) time of 5 minutes or less; cold rolling at a cold reduction rate of 50-96% to a final plate thickness of 40-200 μm; then performing a final anneal at a temperature of 300-400° C.

EFFECTS OF THE INVENTION

The present invention offers an aluminum alloy fin material for heat exchangers whose tensile strength prior to brazing is suitable for easily forming the fins, while having high strength after brazing, and excelling in thermal conductivity, sag resistance, erosion resistance, self-corrosion resistance and sacrificial anode effect, and a method of production thereof.

BEST MODE FOR CARRYING OUT THE INVENTION

The present inventors performed comparisons between rolled materials from conventional DC slab casting and rolled materials from twin belt continuous casting with regard to their strength properties, thermal conductivity, sag resistance, erosion resistance, self-corrosion resistance and sacrificial anode effect, and performed various analyses of the relationships between their compositions, inter annealing conditions and reduction rate, in order to develop an aluminum alloy fin material satisfying the demands for thinner fin materials for heat exchangers, thus achieving the present invention.

The significance of the alloy ingredients used in the aluminum alloy fin materials for heat exchangers of the present invention and the reasons for their restrictions shall be explained below.

[Si: 0.8-1.4 wt %]

Si coexists with Fe and Mn and generates Al—(Fe.Mn)—Si compounds at the submicron level during brazing, thus increasing the strength while simultaneously reducing the Mn solid solution rate to improve the thermal conductivity. If the Si content is less than 0.8 wt %, the effect is not adequate, and if greater than 1.4 wt %, there is the risk of melting the fin materials during brazing. Therefore, the preferable range of content is 0.8-1.4 wt %. The Si content is more preferably 0.9-1.4 wt %.

[Fe: 0.15-0.7 wt %]

Fe coexists with Mn and Si and generates Al—(Fe.Mn)—Si compounds at the submicron level during brazing, thus increasing the strength while simultaneously reducing the Mn solid solution rate to improve the thermal conductivity. If the Fe content is less than 0.15 wt %, the production cost becomes too high due to the need for high-purity ingots. If greater than 0.7 wt %, production of plate materials becomes difficult due to the generation of coarse Al—(Fe.Mn)—Si crystals during casting of the alloys. Therefore, the preferable range of contents is 0.15-0.7 wt %. The Fe content is more preferably in the range of 0.17-0.6 wt %.

[Mn: 1.5-3.0 wt %]

Mn coexists with Fe and Si and is precipitated at high densities in the form of Al—(Fe.Mn)—Si compounds at the submicron level during brazing, thus increasing the strength of the alloy material after brazing. Additionally, since submicron-level Al—(Fe.Mn)—Si precipitates have a strong recrystallization inhibiting function, the recrystallized grains become coarse at 500 μm or greater, thus improving sag resistance and erosion resistance. If the Mn content is less than 1.5 wt %, the effects are not adequate, and if greater than 3.0 wt %, coarse Al—(Fe.Mn)—Si crystals are generating during casting of the alloy, thus making production of plate materials difficult, while the Mn colid solution rate increases so as to reduce the thermal conductivity. Therefore, the range of contents is preferably 1.5-3.0 wt %. The Mn content is more preferably 1.8-3.0 wt %.

[Zn: 0.5-2.5 wt %]

Zn reduces the electrical potential of the fin materials to provide a sacrificial anode effect. If the content is less than 0.5 wt %, the effects are not adequate, and if more than 2.5 wt %, the self-corrosion resistance of the materials is reduced, and the thermal conductivity is decreased due to the Zn forming solid solutions. Therefore, a preferable range of contents should be 0.5-2.5 wt %. The Zn content is more preferably in the range of 1.0-1.5 wt %.

[Mg: 0.05 wt % or less]

Mg influences the brazing ability, and induces the risk of degrading the brazing ability when the content exceeds 0.05 wt %. Particularly in the case of fluoride flux brazing, the fluorine (F) which is a flux ingredient and the Mg in the alloy can tend to react, thus generating compounds such as $MgF_2$, as a result of which the absolute quantity of the flux that is effective at the time of brazing is insufficient, thus making it susceptible to brazing defects. Therefore, the content of Mg as an impurity should be limited to 0.05 wt % or less.

With regard to impurity ingredients other than Mg, the Cu should be limited to 0.2 wt % or less in order not to make the electrical potential cathodic, and since even minute amounts of Cr, Zr, Ti and V can markedly reduce the thermal conductivity of the material, the net content of these elements should preferably be restricted to 0.20 wt % or less.

Next, the significance of thin slab casting conditions, inter annealing conditions, the final cold reduction rate and reasons for the restrictions for their factors in the present invention shall be described.

[Thin Slab Casting Conditions]

The twin belt casting method is a continuous casting method in which a melt is poured between water-cooled rotating belts that oppose each other from above and below, so as to solidify the melt by cooling from the belt surfaces to form a slab, then continuously pulling the slab from the side of the belts opposite the pouring side to wind it into a coil.

In the present invention, the thickness of the cast slab should preferably be 5-10 mm. At this thickness, the solidifying rate is fast even in a central portion in the thickness direction, and it is possible to obtain a fin material excelling in various properties such as having uniform structure, having few coarse compounds with the composition in the range of the present invention, and large crystal grains after brazing.

If the slab thickness due to the twin belt casting machine is less than 5 mm, the amount of aluminum passing through the casting machine per unit time becomes so small that it becomes difficult to cast. On the other hand, when the thickness exceeds 10 mm, it becomes impossible to wind into a roll, so that the range of slab thicknesses should preferably be 5-10 mm.

The casting speed when solidifying the melt should preferably be 5-15 m/min, and solidification should be completed on the belt. If the casting speed is less than 5 m/min, too much time is required for casting, thus reducing productivity. If the casting speed exceeds 15 m/min, the supply of aluminum melt lags behind and it is difficult to obtain a thin slab of predetermined shape.

[Interannealing Conditions]

The temperature maintained for inter annealing should preferably be 350-500° C. When the temperature for inter annealing is maintained at less than 350° C., it is not possible to obtain an adequate state of softening. However, if the temperature for inter annealing is maintained at more than 500° C., much of the solid solution Mn precipitated during brazing is precipitated in the form of comparatively large Al—(Fe.Mn)—Si compounds during inter annealing, so that the recrystallization inhibiting effect during brazing is weakened so that the size of the recrystallized grains become less than 500 μm, thereby reducing the sag resistance and erosion resistance.

While there is no particular restriction on the time over which inter annealing is to be performed, it should preferably be in the range of 1-5 hours. If the inter annealing time is less than 1 hour, the temperature of the coil overall remains uneven, and there is a possibility that an evenly recrystallized structure will not be able to be obtained in the sheet. If the inter annealing time exceeds 5 hours, precipitation of the solid solution Mn will advance, thus not only making it difficult to stably obtain recrystallized grain sizes of 500 μm or more after brazing, but also reducing the productivity due to too much time being used for processing.

While there are no particular restrictions on the heating rate and cooling rate during inter annealing, it should preferably be at least 30° C./hr. If the heating rate and cooling rate are less than 30° C./hr during inter annealing, precipitation of the solid solution Mn may advance, thus not only making it difficult to stably obtain recrystallized grain sizes of 500 μm or more after brazing, but also reducing the productivity due to too much time being used for processing.

The temperatures for inter annealing by a continuous annealing furnace should preferably be 350-500° C. If less than 350° C., it is not possible to obtain an adequate state of softening. However, if the temperature is maintained at more than 500° C., much of the solid solution Mn precipitated during brazing is precipitated in the form of comparatively large Al—(Fe.Mn)—Si compounds during inter annealing, so that the recrystallization inhibiting effect during brazing is weakened so that the size of the recrystallized grains become less than 500 μm, thereby reducing the sag resistance and erosion resistance.

The continuous annealing time should preferably be within 5 minutes. If the continuous annealing time exceeds 5 minutes, the precipitation of solid solution Mn advances, thus not only making it difficult to stably obtain recrystallized grain sizes of 500 μm or more after brazing, but also reducing the productivity due to too much time being used for processing.

With regard to the heating rate and cooling rate during continuous annealing, the heating rate should preferably be at least 100° C./min. If the heating rate during continuous annealing is less than 100° C./min, too much time is used for processing, thus reducing the productivity.

[Final Cold Reduction Rate]

The final cold reduction rate should preferably be 10-96%. If the final cold reduction rate is less than 10%, the strain energy stored by cold rolling is small, so that recrystallization is not completed during the heating process of brazing, thus reducing the sag resistance and erosion resistance. If the final cold reduction rate exceeds 96%, cracks can become larger during rolling, thus reducing yield. Depending on the composition, if the product strength is so high that it is difficult to obtain a predetermined fin shape by fin formation, the various properties will not be lost even if a final cold rolled sheet is finally annealed (softening process) for about 1-3 hours at a temperature of 300-400° C. In particular, a fin material formed by subjecting a sheet that has been inter annealed in a continuous annealing furnace, then finally cold rolled to a further final anneal (softening process) for about 1-3 hours at a temperature of 300-400° C. excels in fin formability and also has high strength after brazing and excels in sag resistance.

The aluminum alloy fin material of the present invention is formed by continuously casting and winding onto a roll a thin slab of thickness 5-10 mm using a twin belt casting machine, then cold rolling to a thickness of 0.05-2.0 mm, inter annealing at a temperature of 350-500° C., cold rolling at a cold reduction rate of 10-96% to a final thickness of 40-200 μm, then performing a final anneal (softening process) at 300-400° C. as needed. This sheet material can be made into a heat exchanger unit by slitting at predetermined widths, then corrugating, and alternately stacking with working fluid conduit materials such as flattened pipes consisting of cladding composed of 3003 alloy or the like covered with braze, then joining by brazing.

According to the method of the present invention, during the thin slab casting by the twin belt casting machine, Al—(Fe.Mn)—Si compounds in the slab evenly and finely crystallize and Mn and Si which are supersaturated into solid solutions in the matrix Al are precipitated at high densities as a Al—(Fe.Mn)—Si phase at the submicron level at the high temperatures during brazing. As a result, the amount of solid solution Mn in the matrix which largely decreases the thermal conductivity is reduced, so that the electrical conductivity is made higher after brazing and excellent thermal conductivity is exhibited. Additionally, for similar reasons, the finely crystallized Al—(Fe.Mn)—Si compounds and the densely precipitated submicron level Al—(Fe.Mn)—Si phase inhibits movement of dislocations during plastic deformation, as a result of which the final sheet after brazing exhibits a high tensile strength. Additionally, the submicron level Al—(Fe.Mn)—Si phase that is precipitated during brazing has a strong recrystallization inhibiting effect, so that the recrystallized grains after brazing become 500 μm or more, thus having good sag resistance, and for the same reason, exhibiting excellent erosion resistance even after brazing. Additionally, since the Mn content is restricted to 1.5 wt % or more in the present invention, the tensile strength will not decrease even if the average grain size of recrystallized grains after brazing exceeds 3000 μm.

Furthermore, melt is solidified at a high solidification rate by twin belt casting machines, so that the Al—(Fe.Mn)—Si compounds crystallized in the thin slab will be uniform and fine. Therefore, in the final fin material, secondary grains with a circular equivalent diameter of at least 5 μm caused by coarse crystals will not be present, thus achieving excellent self-corrosion resistance.

Thus, by casting thin slabs by means of a twin belt continuous casting method, the Al—(Fe.Mn)—Si compounds in the slab ingots can be made uniform and fine, the submicron level Al—(Fe.Mn)—Si phase precipitates after brazing are high in density, and the crystal grain sizes after brazing are coarse to 500 μm or more, thereby resulting in an aluminum alloy fin material for heat exchangers with increased strength after brazing, excelling in thermal conductivity, sag resistance, erosion resistance and self-corrosion resistance, while simultaneously including Zn so as to make the electrical potential of the material anodic to obtain an excellent sacrificial anode effect, and having excellent durability.

EXAMPLES

Herebelow, examples of the present invention shall be described in comparison with comparative examples.

Example 1

As examples of the present invention and comparative examples, alloy melts of the compositions of Alloys Nos. 1-13 indicated in Table 1 were prepared, passed through a ceramic filter, and poured into a twin belt casting mold to obtain 7 mm thick slabs at a casting speed of 8 m/min. The cooling rate during solidification of the melt was 50° C./sec. The slabs were cold rolled to the thicknesses shown in Table 2 to form sheets, then inter annealed by heating at a rate of 50° C./hr and holding for 2 hours at the respective temperatures shown in Table 2, then cooling at a rate of 50° C./hr (to 100° C.) to soften. Next, these sheets were cold rolled to form fin materials that were 50 μm thickness.

As comparative examples, alloy melts of the compositions of Alloys Nos. 14 and 15 in Table 1 were prepared, DC cast according to a conventional process (thickness 500 mm, solidification cooling rate about 1° C./sec), faced, soaked, hot rolled, cold rolled (thickness 84 μm), inter annealed (400° C.×2 hr), and cold rolled to form fin materials that were 50 μm thick.

The following measurements (1)-(3) were performed on the fin materials obtained in the examples of the present invention and the comparative examples.

(1) Tensile strength (MPa) of fin materials.

(2) Heating to 600-605° C.×3.5 min to simulate brazing temperatures, and after cooling, measuring the following:

[1] Tensile strength (MPa).

[2] Electropolishing the surfaces and performing a Barker process to expose the crystal grain structure, and measuring the crystal grain size (1 μm) parallel to the rolling direction with a cutting process.

[3] Self potential (mV) after immersion for 60 minutes in 5% saline solution with a silver-silver chloride electrode as the reference electrode.

[4] Corrosion current density ($\mu A/cm^2$) determined by cathode polarization performed at a potential sweep rate of 20 mV/min in 5% saline solution with a silver-silver chloride electrode as the reference electrode.

[5] Conductivity [% IACS] according to the conductivity testing method described in JIS-H0505.

(3) The amount of sag (mm) with a projection length of 50 mm in the sag testing method described in LWS T 8801.

(4) After corrugating the fin materials, they were placed (load weight 324 g) on the braze surface of a 0.25 mm thick brazing sheet (braze 4045 alloy, cladding rate 8%) coated with non-corrosive fluoride flux, heated at a rate of 50° C./min to 605° C. and held for 5 minutes. After cooling, the braze cross section was observed, and those in which the erosion of the crystal grain boundary of the fin materials was light were rated "good" (○ mark) and those in which the erosion was severe and the melting of the fin materials was conspicuous were rated "poor" (X mark). The shape of corrugation was as described below.

Corrugation: height 2.3 mm×width 21 mm×pitch 3.4 mm, 10 peaks

The results are shown in Table 3.

TABLE 1

| Alloy No. | Si | Fe | Cu | Mn | Mg | Zn | Ti |
|---|---|---|---|---|---|---|---|
| 1 | 1.21 | 0.20 | 0.02 | 2.75 | <0.02 | 1.52 | 0.01 |
| 2 | 1.20 | 0.55 | 0.02 | 2.33 | <0.02 | 1.52 | 0.01 |
| 3 | 1.19 | 0.30 | 0.02 | 2.78 | <0.02 | 1.74 | 0.01 |
| 4 | 1.30 | 0.30 | 0.02 | 2.98 | <0.02 | 1.73 | 0.01 |
| 5 | 1.20 | 0.35 | 0.02 | 2.20 | <0.02 | 1.50 | 0.01 |
| 6 | 1.00 | 0.20 | 0.02 | 2.90 | <0.02 | 1.50 | 0.01 |
| 7 | 0.88 | 0.52 | 0.00 | 1.10 | <0.02 | 1.46 | 0.01 |
| 8 | 1.20 | 0.55 | 0.02 | 3.30 | <0.02 | 1.72 | 0.01 |
| 9 | 0.60 | 0.20 | 0.02 | 2.40 | <0.02 | 1.50 | 0.01 |
| 10 | 1.50 | 0.20 | 0.02 | 2.20 | <0.02 | 1.50 | 0.01 |
| 11 | 1.10 | 0.90 | 0.02 | 2.40 | <0.02 | 1.52 | 0.01 |
| 12 | 1.00 | 0.30 | 0.02 | 2.50 | <0.02 | 0.20 | 0.01 |
| 13 | 1.20 | 0.35 | 0.02 | 2.40 | <0.02 | 2.90 | 0.01 |
| 14 | 0.83 | 0.54 | 0.01 | 1.16 | 0.018 | 1.45 | 0.02 |
| 15 | 0.30 | 0.53 | 0.02 | 1.02 | 0.011 | 1.92 | 0.02 |

TABLE 2

| No. | Alloy No. | Cast Thick. (mm) | Inter Anneal Thick. (μm) | Inter Anneal. | Final Red. | Final Thick. (μm) | Comments |
|---|---|---|---|---|---|---|---|
| 1 | 1 | 7 | 63 | 400° C. | 20% | 50 | Pres. Inv. |
| 2 | 1 | 7 | 84 | 400° C. | 40% | 50 | Pres. Inv. |
| 3 | 2 | 7 | 84 | 400° C. | 40% | 50 | Pres. Inv. |
| 4 | 3 | 7 | 84 | 400° C. | 40% | 50 | Pres. Inv. |
| 5 | 4 | 7 | 84 | 400° C. | 40% | 50 | Pres. Inv. |
| 6 | 5 | 7 | 84 | 400° C. | 40% | 50 | Pres. Inv. |
| 7 | 6 | 7 | 84 | 400° C. | 40% | 50 | Pres. Inv. |
| 8 | 7 | 7 | 84 | 400° C. | 40% | 50 | Comp. Ex. |
| 9 | 8 | 7 | 84 | 400° C. | 40% | 50 | Comp. Ex. |
| 10 | 9 | 7 | 84 | 400° C. | 40% | 50 | Comp. Ex. |
| 11 | 10 | 7 | 84 | 400° C. | 40% | 50 | Comp. Ex. |
| 12 | 11 | 7 | 84 | 400° C. | 40% | 50 | Comp. Ex. |
| 13 | 12 | 7 | 84 | 400° C. | 40% | 50 | Comp. Ex. |
| 14 | 13 | 7 | 84 | 400° C. | 40% | 50 | Comp. Ex. |
| 15 | 1 | 7 | 250 | 400° C. | 80% | 50 | Comp. Ex. |
| 16 | 2 | 7 | 250 | 400° C. | 80% | 50 | Comp. Ex. |
| 17 | 1 | 7 | 84 | 300° C. | 40% | 50 | Comp. Ex. |
| 18 | 1 | 7 | 84 | 520° C. | 40% | 50 | Comp. Ex. |
| 19 | 14 | 500 | 84 | 400° C. | 40% | 50 | Comp. Ex. |
| 20 | 15 | 500 | 84 | 400° C. | 40% | 50 | Comp. Ex. |

effect. Fin material 14 in the comparative examples had a high Zn content, a high corrosion current density and poor self-corrosion resistance. Fin materials 15 and 16 in the comparative examples had a high final reduction, a high tensile strength before brazing and were difficult to form fins. Fin material 17 in the comparative examples had a low inter anneal temperature, a high tensile strength before brazing, and a large degree of sag, so as to have poor sag resistance. Fin material 18 in the comparative examples had a high inter anneal temperature, a small crystal grain size after brazing, poor erosion resistance, and a large degree of sag, so as to have poor sag resistance. Fin material 19 in the comparative examples with a low Mn content and fin material 20 in the comparative examples with low Si and Mn contents obtained by DC casting according to a conventional process (thickness: 500 mm, solidification cooling rate about 1° C./sec), facing, soaking, hot rolling, cold rolling (thickness 84 μm), inter annealing (400° C.×2 hr), and cold rolling had low tensile strength after brazing, small crystal grain size after brazing, poor erosion resistance, high corrosion current density and poor self-corrosion resistance.

TABLE 3

| No. | Alloy No. | Ten. Str. before Braz. (MPa) | Ten. Str. after Braz. (MPa) | Crys. Grain Size (μm) | Sag (mm) | Self Pot. (mV) | Corr. Curr. Dens. (μA/cm$^2$) | Cond. % IACS | Ero. Res. | Comments |
|---|---|---|---|---|---|---|---|---|---|---|
| 1 | 1 | 226 | 156 | 5000 | 12.4 | −825 | 0.7 | 43.6 | ○ | Pres. Inv. |
| 2 | 1 | 235 | 156 | 3200 | 14.5 | −826 | 0.7 | 43.6 | ○ | Pres. Inv. |
| 3 | 2 | 234 | 155 | 2300 | 13.8 | −821 | 0.9 | 44.3 | ○ | Pres. Inv. |
| 4 | 3 | 238 | 156 | 2000 | 16.7 | −816 | 0.8 | 41.6 | ○ | Pres. Inv. |
| 5 | 4 | 239 | 161 | 2400 | 15.8 | −815 | 0.9 | 41.3 | ○ | Pres. Inv. |
| 6 | 5 | 220 | 155 | 2700 | 17.8 | −817 | 0.6 | 44.3 | ○ | Pres. Inv. |
| 7 | 6 | 223 | 157 | 3100 | 17.9 | −805 | 0.8 | 41.5 | ○ | Pres. Inv. |
| 8 | 7 | 206 | 129 | 590 | 18.0 | −797 | 0.6 | 46.0 | ○ | Comp. Ex. |
| 9 | 8 | Giant crystals formed during casting, cracked when rolled | | | | | | — | | Comp. Ex. |
| 10 | 9 | 216 | 135 | 2100 | 19.0 | −824 | 0.7 | 43.8 | ○ | Comp. Ex. |
| 11 | 10 | 276 | 167 | 2800 | 21.0 | −821 | 0.7 | 43.7 | X | Comp. Ex. |
| 12 | 11 | Giant crystals formed during casting, cracked when rolled | | | | | | — | | Comp. Ex. |
| 13 | 12 | 232 | 154 | 3100 | 16.0 | −730 | 0.6 | 43.9 | ○ | Comp. Ex. |
| 14 | 13 | 229 | 153 | 2900 | 18.0 | −875 | 2.1 | 43.8 | X | Comp. Ex. |
| 15 | 1 | 260 | 161 | 650 | 18.8 | −825 | 0.7 | 43.6 | ○ | Comp. Ex. |
| 16 | 2 | 258 | 159 | 820 | 18.7 | −820 | 0.9 | 44.3 | ○ | Comp. Ex. |
| 17 | 1 | 290 | 159 | 1800 | 34.2 | −823 | 0.7 | 43.4 | ○ | Comp. Ex. |
| 18 | 1 | 230 | 157 | 190 | 30.3 | −821 | 0.7 | 43.3 | X | Comp. Ex. |
| 19 | 14 | 190 | 134 | 110 | 19.8 | −798 | 1.7 | 43.9 | X | Comp. Ex. |
| 20 | 15 | 176 | 112 | 90 | 27.0 | −813 | 2.0 | 38.2 | X | Comp. Ex. |

The results of Table 3 show that the fin materials of the present invention have good properties for tensile strength after brazing, erosion resistance, sag resistance, sacrificial anode effect and self-corrosion resistance. Fin material 8 in the comparative examples had a low Mn content and low tensile strength after brazing. Fin material 9 in the comparative examples had a high Mn content, such that giant crystals were formed during casting, and cracked when cold rolled, so that fin materials were not able to be obtained. Fin material 10 in the comparative examples had a low Si content and low tensile strength after brazing. Fin material 11 in the comparative examples had a high Si content and poor erosion resistance. Fin material 12 in the comparative examples had a high Fe content, such that giant crystals were formed during casting, and cracked when cold rolled, so that fin materials were not able to be obtained.

Fin material 13 in the comparative examples had a low Zn content, with high self-potential and poor sacrificial anode

Example 2

Twin belt cast slabs produced from melts of Alloys 1 and 2 indicated in Table 1 obtained as Example 1 among the examples and comparative examples were divided, cold rolled to inter anneal plate thicknesses under the sheet production conditions indicated in Table 4, then heated at a heating rate of 100° C./sec in a continuous anneal furnace and inter annealed by water cooling without holding at 450° C. to soften. Next, the sheets were cold rolled at the final cold reduction rate shown in Table 4 to a thickness of 50 μm. Furthermore, with regard to fin materials 21-23 of the examples and fin materials 27-30 of the comparative examples, these were subjected to a final anneal by heating at a rate of 50° C./hr and holding for 2 hours at the respective temperatures shown in Table 4, then cooling at a cooling rate of 50° C./hr (to 100° C.) to soften. These fin materials were evaluated for tensile strength before brazing, tensile strength after brazing, crystal grain size after brazing, erosion resistance, sag resistance, sacrificial anode effect and self-corrosion resistance, the results being shown in Table 4.

TABLE 4

| No. | Alloy No. | Inter Anneal Thick. (mm) | Inter Anneal | Final Red. | Final Anneal | Final Thick. (μm) | Comments |
|---|---|---|---|---|---|---|---|
| 21 | 1 | 0.25 | 450° C. | 80% | 350° C. | 50 | Pres. Inv. |
| 22 | 1 | 1.00 | 450° C. | 95% | 350° C. | 50 | Pres. Inv. |
| 23 | 2 | 1.00 | 450° C. | 95% | 350° C. | 50 | Pres. Inv. |
| 24 | 1 | 0.25 | 450° C. | 80% | none | 50 | Comp. Ex. |
| 25 | 1 | 1.00 | 450° C. | 95% | none | 50 | Comp. Ex. |
| 26 | 2 | 1.00 | 450° C. | 95% | none | 50 | Comp. Ex. |
| 27 | 1 | 1.00 | 450° C. | 95% | 250° C. | 50 | Comp. Ex. |
| 28 | 2 | 1.00 | 450° C. | 95% | 250° C. | 50 | Comp. Ex. |
| 29 | 1 | 1.00 | 450° C. | 95% | 450° C. | 50 | Comp. Ex. |
| 30 | 2 | 1.00 | 450° C. | 95% | 450° C. | 50 | Comp. Ex. |

TABLE 5

| No. | Alloy No. | Ten. Str. before Braz. (MPa) | Ten. Str. after Braz. (MPa) | Crys. Grain Size (μm) | Sag (mm) | Self Pot. (mV) | Corr. Curr. Dens. (μA/cm$^2$) | Cond. % IACS | Ero. Res | Comments |
|---|---|---|---|---|---|---|---|---|---|---|
| 21 | 1 | 231 | 164 | 4100 | 11.3 | −796 | 0.7 | 42.5 | ○ | Pres. Inv. |
| 22 | 1 | 233 | 166 | 2900 | 18.3 | −792 | 0.7 | 42.4 | ○ | Pres. Inv. |
| 23 | 2 | 228 | 165 | 2300 | 15.9 | −802 | 0.9 | 43.1 | ○ | Pres. Inv. |
| 24 | 1 | 338 | 166 | 3000 | 43.8 | −798 | 0.7 | 42.4 | ○ | Comp. Ex. |
| 25 | 1 | 389 | 168 | 3000 | 33.5 | −795 | 0.7 | 42.6 | ○ | Comp. Ex. |
| 26 | 2 | 390 | 168 | 2800 | 34.3 | −804 | 0.9 | 43.2 | ○ | Comp. Ex. |
| 27 | 1 | 275 | 167 | 3000 | 40.2 | −794 | 0.7 | 42.3 | ○ | Comp. Ex. |
| 28 | 2 | 271 | 167 | 2400 | 39.4 | −801 | 0.9 | 43.1 | ○ | Comp. Ex. |
| 29 | 1 | 173 (○ material) | 164 | 2700 | 0.1 | −796 | 0.7 | 42.2 | ○ | Comp. Ex. |
| 30 | 2 | 176 (○ material) | 166 | 3800 | 0.6 | −801 | 0.9 | 43.2 | ○ | Comp. Ex. |

As shown in Table 5, the fin materials 21, 22 and 23 produced by the methods of the present invention all excel in terms of tensile strength after brazing, erosion resistance, sag resistance, sacrificial anode effect and self-corrosion resistance. On the other hand, fin materials 24, 25 and 26 of the comparative examples, with a high final cold reduction rate and in which a final anneal is not performed have a high tensile strength before brazing so as to make fin formation difficult, and have a large degree of sag, so as to have poor sag resistance. Fin materials 27 and 28 of the comparative examples processed at low final anneal temperatures have a high tensile strength before brazing so as to make fin formation difficult, and have a large degree of sag, so as to have poor sag resistance. The fin materials 29 and 30 of the comparative examples processed at a high final anneal temperature have low tensile strength before brazing but form O-materials, with high elongation rates of respectively 11% and 12%, thus making them difficult to form into fins.

INDUSTRIAL APPLICABILITY

The present invention offers an aluminum alloy fin material for heat exchangers whose tensile strength prior to brazing is suitable for easily forming the fins, while having a high strength after brazing, and excelling in thermal conductivity, sag resistance, erosion resistance, self-corrosion resistance and sacrificial anode effect, and a method of production thereof.

The invention claimed is:

1. A high-strength aluminum alloy fin material for heat exchangers having high strength, comprising:

aluminum,
0.8-1.4 wt % of Si,
0.15-0.7 wt % of Fe,
1.5-3.0 wt % of Mn,
0.5-2.5 wt % of Zn,
at most 0.05 wt % of Mg,
0.02 wt % or less of Cu, and
the remainder comprises impurities;
wherein said aluminum alloy fin material:
has a tensile strength before brazing of at most 240 MPa;
a tensile strength after brazing of 150 MPa or more; and
a recrystallized grain size after brazing of 500 μm or more.

2. The high-strength aluminum alloy fin material according to claim 1, comprising from 0.9 to 1.4 wt % of Si.

3. The high-strength aluminum alloy fin material according to claim 1, comprising from 0.17 to 0.55 wt % of Fe.

4. The high-strength aluminum alloy fin material according to claim 1, comprising from 2.2 to 3.0 wt % of Mn.

5. The high-strength aluminum alloy fin material according to claim 1, comprising from 1.0 to 1.5 wt % of Zn.

6. The high-strength aluminum alloy fin material according to claim 1, wherein the tensile strength before brazing is from 220-240 MPa.

7. The high-strength aluminum alloy fin material according to claim 1, wherein the tensile strength after brazing is from 150-166 MPa.

8. The high-strength aluminum alloy fin material according to claim 1, exhibiting a corrosion current density of from 0.6 to 0.9 μA/cm$^2$.

9. The high-strength aluminum alloy fin material according to claim 1, exhibiting a sag of from 12.4 to 18.0 mm.

10. The high-strength aluminum alloy fin material according to claim 1, wherein said impurities comprise Cr, Zr, Ti, and V.

11. The high-strength aluminum alloy fin material according to claim 10, wherein Cr, Zr, Ti and V are present in an amount of at most 0.20 wt %.

12. The high-strength aluminum alloy fin material according to claim 1, comprising from 1.8 to 3.0 wt % of Mn.

13. The high-strength aluminum alloy fin material according to claim 1, wherein said recrystallized grain size after brazing is from 2000-5000 μm.

14. The high-strength aluminum alloy fin material according to claim 1, which consists essentially of said impurities, Si, Fe, Mn, Zn, Mg, Cu, and Al.

15. The high-strength aluminum alloy fin material according to claim 1, which consists of said impurities, Si, Fe, Mn, Zn, Mg, Cu, and Al.

16. A high-strength aluminum alloy fin material for heat exchangers having high strength, comprising:

aluminum, 1.1-1.4 wt % of Si, 0.15-0.55 wt % of Fe, 2.2-3.0 wt % of Mn, 0.5-2.5 wt % of Zn, at most 0.05 wt % of Mg, and the remainder comprising impurities;

wherein said aluminum alloy fin material:

has a tensile strength before brazing of at most 240 MPa;

a tensile strength after brazing of 150 MPa or more; and a recrystallized grain size after brazing of 500 μm or more.

17. The high-strength aluminum alloy fin material according to claim 16, comprising at most 0.2 wt % of Cu.

18. The high-strength aluminum alloy fin material according to claim 16, comprising 0.02 wt % or less of Cu.

19. A high-strength aluminum alloy for heat exchangers having high strength, comprising:

aluminum, 0.8-1.4 wt % of Si, 0.15-0.7 wt % of Fe, 2.33-3.0 wt % of Mn, 0.5-2.5 wt % of Zn, at most 0.05 wt % of Mg, and the remainder comprising impurities;

wherein said aluminum alloy:

has a tensile strength before brazing of at most 240 MPa;

a tensile strength after brazing of 150 MPa or more; and a recrystallized grain size after brazing of 500 μm or more.

20. The high-strength aluminum alloy according to claim 19, comprising from 1.1 to 1.4 wt % of Si.

21. The high-strength aluminum alloy according to claim 19, comprising from 0.15 to 0.55 wt % of Fe.

22. The high-strength aluminum alloy according to claim 19, comprising from 1.0 to 1.5 wt % of Zn.

23. The high-strength aluminum alloy according to claim 19, wherein said impurities comprise Cu, Cr, Zr, Ti, and V.

24. The high-strength aluminum alloy according to claim 19, wherein said recrystallized grain size after brazing is from 2000-5000 μm.

25. The high-strength aluminum alloy according to claim 19, which consists essentially of said impurities, Si, Fe, Mn, Zn, Mg, and Al.

26. The high-strength aluminum alloy according to claim 19, which consists of said impurities, Si, Fe, Mn, Zn, Mg, and Al.

27. The high-strength aluminum alloy according to claim 19, comprising 0.02 wt % or less of Cu.

* * * * *